US009169036B2

(12) United States Patent
Leung

(10) Patent No.: US 9,169,036 B2
(45) Date of Patent: Oct. 27, 2015

(54) STORAGE BOX

(71) Applicant: Ming Fuk Leung, Hong Kong (CN)

(72) Inventor: Ming Fuk Leung, Hong Kong (CN)

( * ) Notice: Subject to any disclaimer, the term of this patent is extended or adjusted under 35 U.S.C. 154(b) by 0 days.

(21) Appl. No.: 14/156,695

(22) Filed: Jan. 16, 2014

(65) Prior Publication Data

US 2015/0144684 A1 May 28, 2015

(30) Foreign Application Priority Data

Nov. 28, 2013 (CN) ..... 2013 1 0614612

(51) Int. Cl.
*B65D 5/36* (2006.01)
*B65D 3/28* (2006.01)
*A45C 7/00* (2006.01)

(52) U.S. Cl.
CPC ..... *B65D 3/28* (2013.01); *A45C 7/0036* (2013.01); *B65D 5/36* (2013.01)

(58) Field of Classification Search
CPC ..... B65D 3/28; B65D 5/36; A45C 7/0036
USPC ..... 229/117.02, 117.03, 117.05, 117.06, 229/125.19, 165, 173, 181, 122.34; 220/6, 220/23.9, 495.01, 652, 653, 666; 190/107, 190/125
See application file for complete search history.

(56) References Cited

U.S. PATENT DOCUMENTS

| | | | | |
|---|---|---|---|---|
| 736,727 | A * | 8/1903 | Hirsch | 229/173 |
| 831,415 | A * | 9/1906 | Carnahan | 229/117.02 |
| 1,176,755 | A * | 3/1916 | Heinrich | 229/117.01 |
| 1,879,102 | A * | 9/1932 | Collins | 190/35 |
| 2,761,609 | A * | 9/1956 | Arkin | 229/117.05 |
| 5,086,888 | A * | 2/1992 | Chu | 190/107 |
| 6,478,217 | B1 * | 11/2002 | Lombardi et al. | 229/122.34 |
| 6,920,993 | B2 * | 7/2005 | Sheng-Bin | 220/6 |
| 7,011,224 | B2 * | 3/2006 | Sheng-Bin | 220/6 |
| 7,534,041 | B2 * | 5/2009 | Godshaw et al. | 190/107 |
| 2008/0135548 | A1 * | 6/2008 | Fu | 220/6 |
| 2008/0237321 | A1 * | 10/2008 | Chen | 229/117.05 |
| 2010/0187227 | A1 * | 7/2010 | Wang | 220/6 |
| 2011/0168598 | A1 * | 7/2011 | Rees et al. | 220/6 |
| 2011/0240724 | A1 * | 10/2011 | Wang | 229/117.03 |
| 2012/0018330 | A1 * | 1/2012 | Kato et al. | 206/372 |
| 2012/0187118 | A1 * | 7/2012 | Glenn | 220/6 |
| 2013/0008912 | A1 * | 1/2013 | Wang | 220/666 |
| 2014/0117072 | A1 * | 5/2014 | Cullen et al. | 229/117.05 |

FOREIGN PATENT DOCUMENTS

| | | | | |
|---|---|---|---|---|
| EP | 1598278 | A1 * | 11/2005 | B65D 5/36 |
| GB | 482925 | A * | 4/1938 | B65D 5/36 |

* cited by examiner

*Primary Examiner* — Gary Elkins
(74) *Attorney, Agent, or Firm* — Jackson IPG PLLC; Demian K. Jackson

(57) ABSTRACT

The invention relates to the technical field of supplies, in particular to a storage box, comprises a foldable box main body, the bottom of which is provided with a substrate made of soft material, and further comprising a soleplate supporting the box main body, the soleplate being detachably disposed on the substrate. The box main body is also movably connected with a lug plate for resisting against the soleplate. For the storage box disclosed by the invention, during transportation or when not in use, the box main body may be folded conveniently for storage, so that a small space is occupied and convenience and practicality are realized; and when the storage box is unfolded to accommodate articles, four edges of the soleplate placed inside the box main body are resisted against sides of the box main body so that the box main body is kept unfolded.

11 Claims, 9 Drawing Sheets

STORAGE BOX

FIELD OF THE INVENTION

The present invention relates to the technical field of supplies, in particular to a storage box.

BACKGROUND OF THE INVENTION

As one of accommodation tools frequently used in daily work, life and learning, storage boxes may allow accommodation of office supplies, cosmetics, documents, small tools, clothes, shoes and other small items conveniently, so that people may enjoy more convenient, conformable, clean and tidy home life and work.

There are various kinds of storage boxes at present. Although the storage boxes, made of hard material, have firm structure and also convenience in storage of articles, they may occupy a large space during the transportation or when not in use as they cannot be folded for storage; and, although the storage boxes, made of soft material, can be folded for storage, they have a disadvantage of poor stability. On this basis, storage boxes made of combination of hard material and soft material have been developed and researched. The box main body of such a storage box is generally made of hard material and provided with foldable fold lines, while the box main body is made of high-flexibility material and the bottom of the box main body is detachably provided with a hard soleplate. The foldable storage of the storage box may be realized conveniently as long as the hard soleplate is taken out.

An existing foldable storage box generally comprises a soleplate and four side plates. Side edges of the side plates are connected in turn to form a cylindrical shape, and each of the joints may be folded over at will. A substrate for connecting and sealing the bottom edges of all side plates is provided. The substrate is made of high-flexibility material, on which the soleplate is detachably disposed. Two opposite side plates are provided with a folding portion, respectively, along which the side plates may be folded inward.

When the above foldable storage box is unfolded for use, the soleplate is placed inside the box main body formed by the side plates to support the side plates and form a firm chamber with the side plates, which is convenient for accommodating articles. When required to be folded for storage, the storage box may be folded conveniently just by taking the soleplate out and then folding the side plates inward. Such foldable storage box has good effect when placed on a flat plane for use. However, when such foldable storage box is placed in an uneven place or a rugged place, the side plates are not in contact with the placement plane, instead, only the soleplate is in contact with the placement plane; or, the foldable storage box will lose the support of the placement plane during the moving process, so that the soleplate will move under the action of an external force because the soleplate is detachably connected with the substrate, thereby influencing the use effect. More seriously, the soleplate will turn over further not to support the side plates, so that the side plates are likely to have folding deformation to result in an instable structure, as a result, the foldable storage box cannot be used.

SUMMARY OF THE INVENTION

With regard to the defects of the prior art, an object of the present invention is to provide a storage box, which may be folded for storage conveniently and is also firm in structure and unlikely to have deformation when unfolded for use.

The present invention is implemented by the following technical solutions.

A storage box is provided, comprising a foldable box main body, the bottom of which is provided with a substrate made of soft material, and further comprising a soleplate for supporting the box main body. The soleplate is detachably disposed on the substrate. The box main body is also movably connected with a lug plate for resisting against the soleplate.

Wherein, the box main body consists of a front side plate, a right side plate, a rear side and a left side plate connected in turn. The bottoms of the front side plate, the right side plate, the rear side plate and the left side plate are connected with the substrate to form a space for accommodating articles together.

Preferably, the front side plate, the right side plate, the rear side plate and the left side plate are all paperboards, and the joints of the front side plate, the right side plate, the rear side plate and the left side plate are all made of high-flexibility material.

Wherein, the left side plate and the right side plate disposed opposite to each other are symmetrically provided a folding portion, respectively, so that the left side plate and the right side plate can be folded inward along the folding portions; and one side edge of the soleplate is movably connected with the bottom of the front side plate or rear side plate in a foldable way, and the rear side plate or front side plate is connected with a lug plate that is movably connected with the rear side plate or front side plate in a foldable way.

Wherein, the left side plate and the right side plate disposed opposite to each other are symmetrically provided a folding portion, respectively, so that the left side plate and the right side plate can be folded inward along the folding portions; and four edges of the soleplate are resisted against the front side plate, the right side plate, the rear side plate and the left side plate of the main body, and the front side plate and the rear side plate opposite to each other are connected with a lug plate for resisting against the soleplate, respectively, the two lug plates being movably connected with the front side plate and the rear side plate in a foldable way.

Wherein, the joints of the two lug plates and the front side plate and the rear side plate are all provided with a fold line.

Further, the storage box further comprises magnetic buttons for attracting the lug plates with the front side plate and the rear side plate. The magnetic buttons comprise auxiliary buttons separately disposed on the two lug plates and main buttons separately disposed at corresponding positions on the front side plate and the rear side plate. The auxiliary buttons and the main buttons are attracted together by the magnetism.

Further, a soleplate handle is provided at one end of the soleplate, and the moving side of each of the lug plate is provided with a lug plate handle.

Wherein, both the soleplate handle and the lug plate handle are thin slices with certain flexibility.

Further, the storage box further comprises a lid fitted with the box main body, and the lid is detachably covered on the top of the box main body.

Compared with the prior art, the present invention has the following advantages: for the storage box disclosed by the present invention, during transportation or when not in use, the box main body may be folded conveniently for storage, so that a small space is occupied and convenience and practicality are realized; and when the storage box is unfolded to accommodate articles, four edges of the soleplate placed inside the box main body are resisted against sides of the box main body so that the box main body is kept unfolded. The lug plate movably connected with the main body is further utilized to resist against and fix the soleplate so that the soleplate is firmly fixed between the substrate and the lug plate. Even if the storage box disclosed by the present invention is placed in a rugged place, the stability of installation of the soleplate can be ensured, and there will be no location displacement, turnover or similar events due to the uneven stress of the soleplate. The storage box has improved structure stability when unfolded for use and high practicality.

DETAILED DESCRIPTION OF THE INVENTION

The present invention will be described as below in details with reference to the drawings.

Embodiment 1

Figure 1:
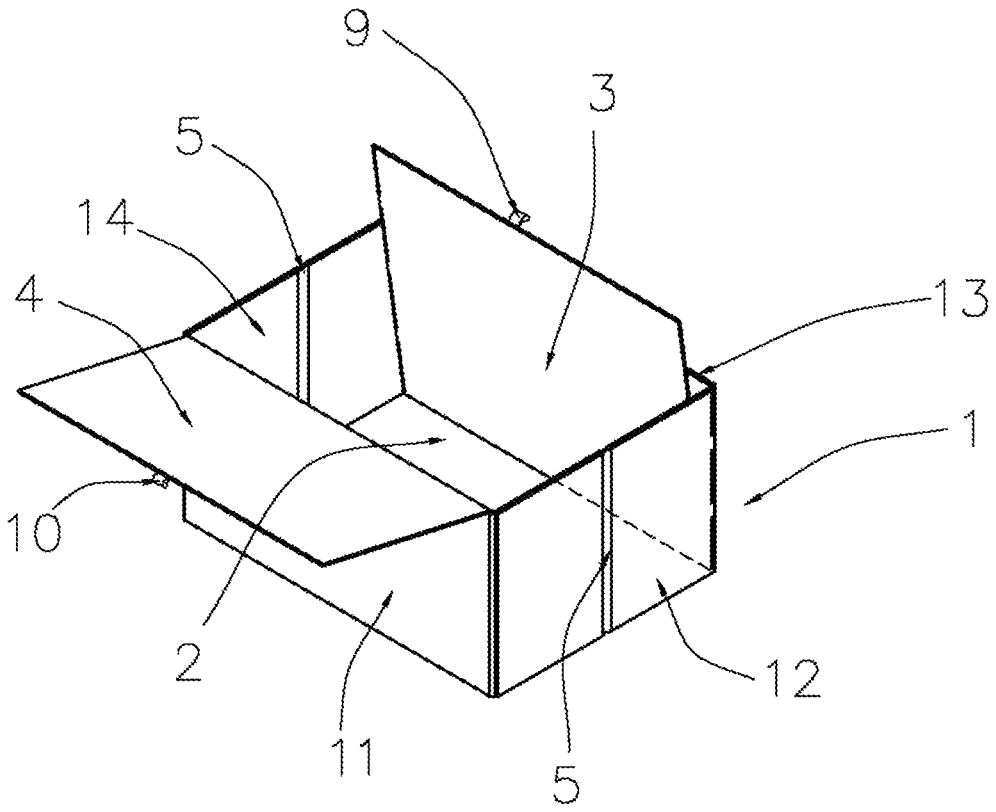
FIG. 1 is a structure diagram of a lug plate and a soleplate according to Embodiment 1 of the present invention when unfolded.

Referring to FIG. 1, a storage box comprises a foldable box main body 1, the bottom of which is provided with a substrate 2 made of soft material, and further comprises a soleplate 3 for supporting the box main body. The soleplate 3 is detachably disposed on the substrate 2. The box main body 1 is also movably connected with a lug plate 4 for resisting against the soleplate 3.

Specifically, the storage box in this embodiment comprises a soleplate 3 and a lug plate 4 for resisting against the soleplate 3. A left side plate 14 and a right side plate 12 disposed opposite to each other are symmetrically provided with a folding portion 5, respectively, so that the left side plate 14 and the right side plate 12 can be folded inward along the folding portions 5; and one side edge of the soleplate 3 is movably connected with the bottom of a front side plate 11 or a rear side plate 13 in a foldable way, and the rear side plate 13 or the front side plate 11 is connected with a lug plate 4 that is movably connected with the rear side plate 13 or the front side plate 11 in a foldable way. The soleplate 3 and the lug plate 4 are connected with two opposite side plates of the box main body 1 in a foldable way, respectively. When the storage box is unfolded for use, the soleplate 3 is placed on the upper surface of the substrate 2 in parallel, and the lug plate 4 is resisted against the moving side of the soleplate 3, so that the soleplate 3 is firmly fixed between the substrate 2 and the lug plate 4. In the present invention, the structure is simple; and, the storage box can be folded for storage conveniently, and also the storage box is stable in structure when unfolded for use and has high practicality. The connection between one side edge of the soleplate 3 and the box main body 1 may effectively avoid the loss of the soleplate 3.

Embodiment 2

Figure 2:
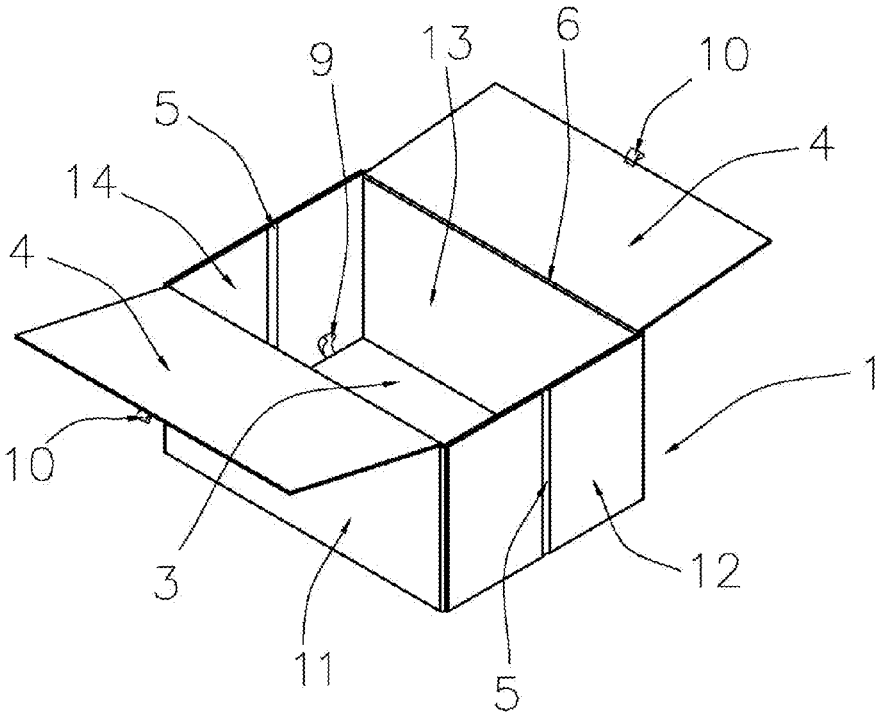
FIG. 2 is a structure diagram of a lug plate according to Embodiment 2 of the present invention when unfolded.
Figure 3:
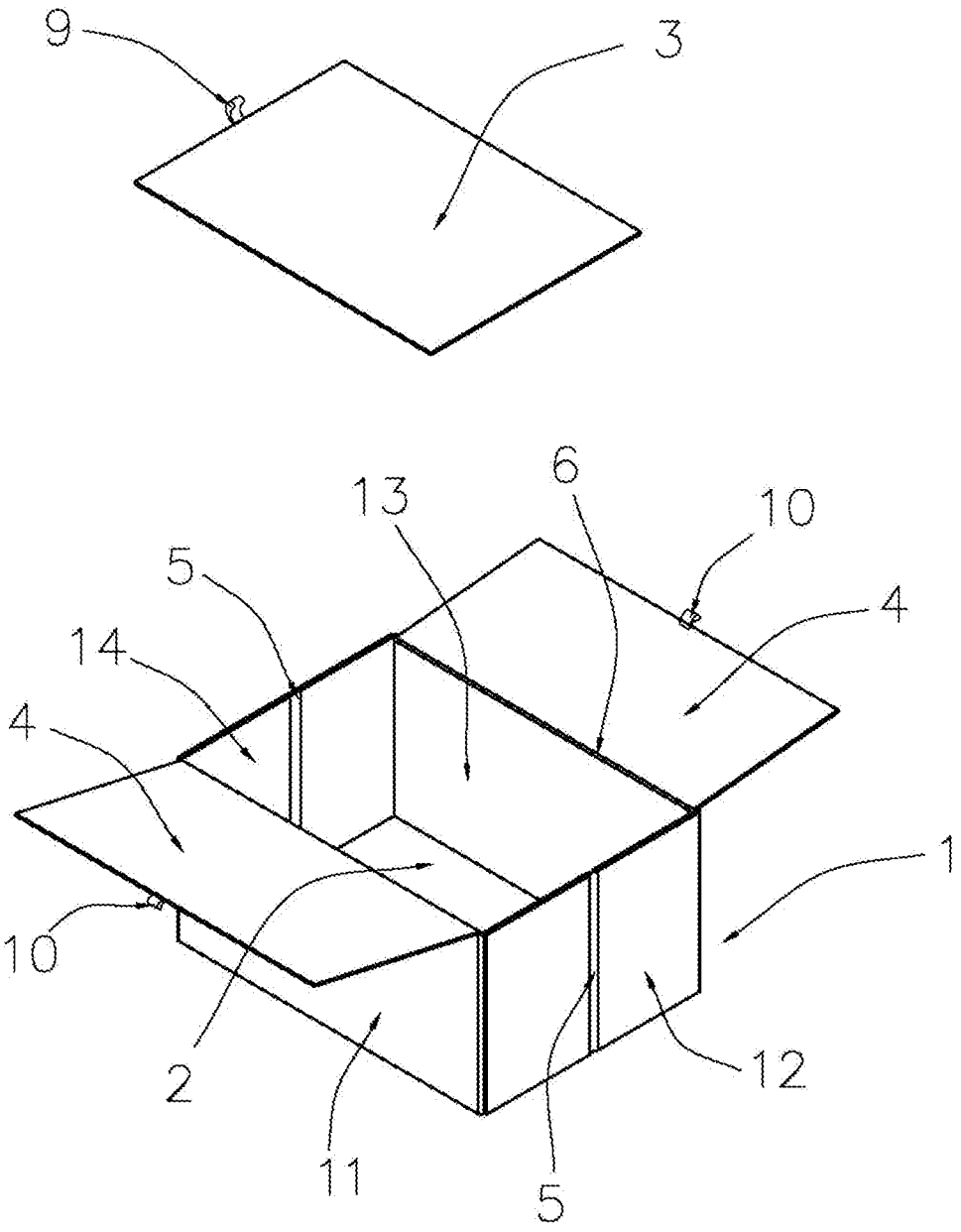
FIG. 3 is an exploded structure diagram of a lug plate according to Embodiment 2 of the present invention when unfolded.
Figure 4:
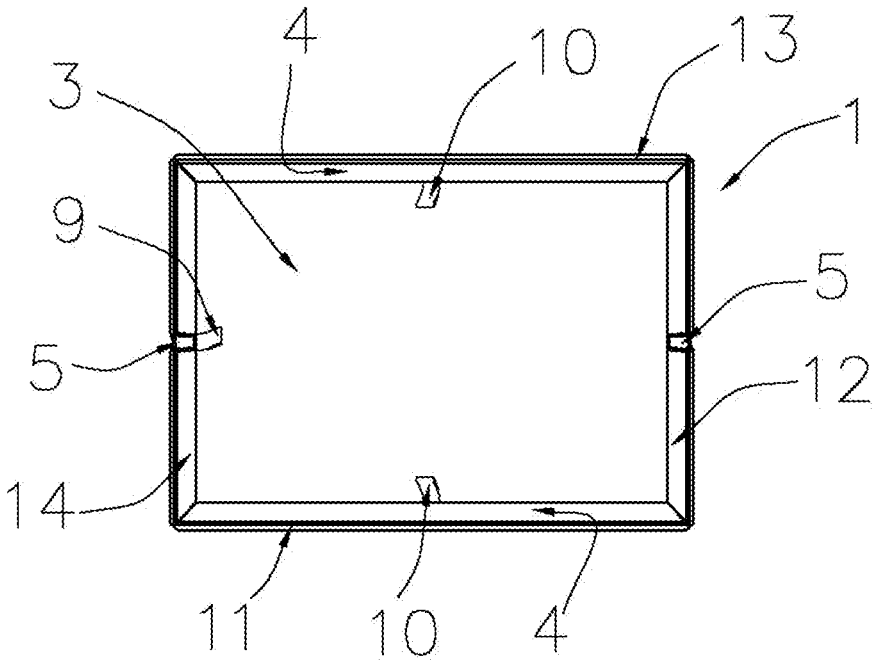
FIG. 4 is a top view of a lug plate according to Embodiment 2 of the present invention when resisted.

Referring to FIG. 2 to FIG. 4, the difference between this embodiment and Embodiment 1 is that: the soleplate 3 in this embodiment is detachably connected with the box main body 1 and may be taken out from the box main body 1, and four sides of the soleplate 3 when the storage box is unfolded for use are resisted against the side edges of the box main body 1.

Specifically, when the storage box needs to be used for accommodating articles, the soleplate 3 is placed inside the box main body 1, the soleplate 3 is placed on the upper surface of the substrate 2 in parallel, and four sides of the soleplate 3 are resisted against the front side plate 11, the right side plate 12, the rear side plate 13 and the left side plate 14, respectively, so that the box main body 1 is unfolded. Further, the lug plate 4 movably connected with the box main body 1 is resisted against and fix the soleplate 3, so that the soleplate 3 is firmly fixed between the substrate 2 and the lug plate 4. Even if the storage box disclosed by the present invention is placed in a rugged place, the stability of installation of the soleplate 3 can be ensured, and there will be no location displacement, turnover or similar events due to the uneven stress of the soleplate 3. The storage box has improved structure stability when unfolded for use and high practicality. During transportation or when not in use, the storage box disclosed by the present invention may be folded for storage. First, the lug plate 4 is folded upward and outward, then the soleplate 3 is taken out, and the lug plate 4 is folded to the original position to cling to the insides of the side edges of the box main body 1, thus the box main body 1 may be folded conveniently for storage, so that a small space is occupied and it is convenient to store the storage box during transportation or when not in use.

On the other hand, when the storage box is unfolded, the soleplate 3 clings to the insides of the side edges of the box main body 1 so as to support the side edges of the box main body 1, so that the strength and ability against the extrusion of an external force of the box main body 1 are improved, and the structure stability of the storage box disclosed by the present invention is further improved.

The substrate 2 is connected with side walls of the box main body 1, respectively. When the storage box is in use, the substrate 2 forms rigid support to the soleplate 3 and is preferably made of high-flexibility material. The substrate 2 can bear multiple times of folding operations without any damage.

Wherein, the box main body 1 consists of the front side plate 11, the right side plate 12, the rear side 13 and the left side plate 14 connected in turn. The bottoms of the front side plate 11, the right side plate 12, the rear side plate 13 and the left side plate 14 are connected with the substrate 2. The front side plate 11, the right side plate 12, the rear side plate 13 and the left side plate 14 form a space for accommodating articles together with the substrate 12.

Preferably, the front side plate 11, the right side plate 12, the rear side plate 13 and the left side plate 14 are all paperboards, having advantages of not only light weight and portability, but also no color, no smell, low cost, and high economical efficiency and practicability. The joints of the front side plate 11, the right side plate 12, the rear side plate 13 and the left side plate 14 are all made of high-flexibility material that can bear multiple times of folding operations without any damage, so that the service life of the storage box disclosed by the present invention is prolonged.

Further, the front side plate 11, the right side plate 12, the rear side plate 13 and the left side plate 14 all consist of two layers of paperboards, and the two layers of paperboards are spliced together, so that the structural strength of the front side plate 11, the right side plate 12, the rear side plate 13 and the left side plate 14 is further improved. The substrate 2 is connected into a clearance between the two layers of paperboards, so that the substrate 2 may be conveniently connected to the front side plate 11, the right side plate 12, the rear side plate 13 and the left side plate 14, respectively. Thus, it is advantageous to improve the firmness of connection of the substrate 2, and also provide the storage box disclosed by the present invention with uniform appearance, beautiful design and beneficial market promotion.

Wherein, the left side plate 14 and the right side plate 12 disposed opposite to each other are symmetrically provided with a folding portion 5, respectively, so that the left side plate 14 and the right side plate 12 can be folded inward along the folding portions 5. Consequently, the box main body 1 may be folded for storage conveniently and the folded box main body 1 is small in size. The front side plate 11 and the rear side plate 13 disposed opposite to each other are provided with a lug plate 4, respectively, and the two lug plates 4 are movably connected with the front side plate 11 and the rear side plate 13 in a foldable way, respectively, so that the two lug plates 4 disposed on the front side plate 11 and the rear side plate 13 resist against the soleplate 3 from two sides when the box main body 1 is unfolded. As a result, the installation stability of the soleplate 3 may be further improved.

Wherein, the joints of the two lug plates 4 with the front side plate 11 and the rear side plate 13 are all provided with a fold line 6 by which the lug plates 4 may be folded inward or outward conveniently, with high practicability.

Further, a soleplate handle 9 is provided at one end of the soleplate 3. When the storage box disclosed by the present invention is unfolded for use, the soleplate 3 is flatly placed on the substrate 2 and the four sides of the soleplate 3 are separately resisted against the side edges of the box main body 1; a soleplate handle 9 is provided at one end of the soleplate 3, clinging closely to the edge of the soleplate 3 and being exposed outside, so that the soleplate 3 may be pulled out conveniently by the soleplate handle 9; and, the moving side of each of the lug plates 4 is provided with a lug plate handle 10, so that the lug plates 4 may be pulled and folded conveniently.

Wherein, as thin slices with certain flexibility, both the soleplate handle 9 and the lug plate handle 10 not only can be pulled out conveniently, but also occupy no inner space of the box main body 1.

The soleplate of this embodiment is detachable to the box main body, resulting in convenient processing, high production efficiency, and reduced production cost.

Embodiment 3

Figure 5:
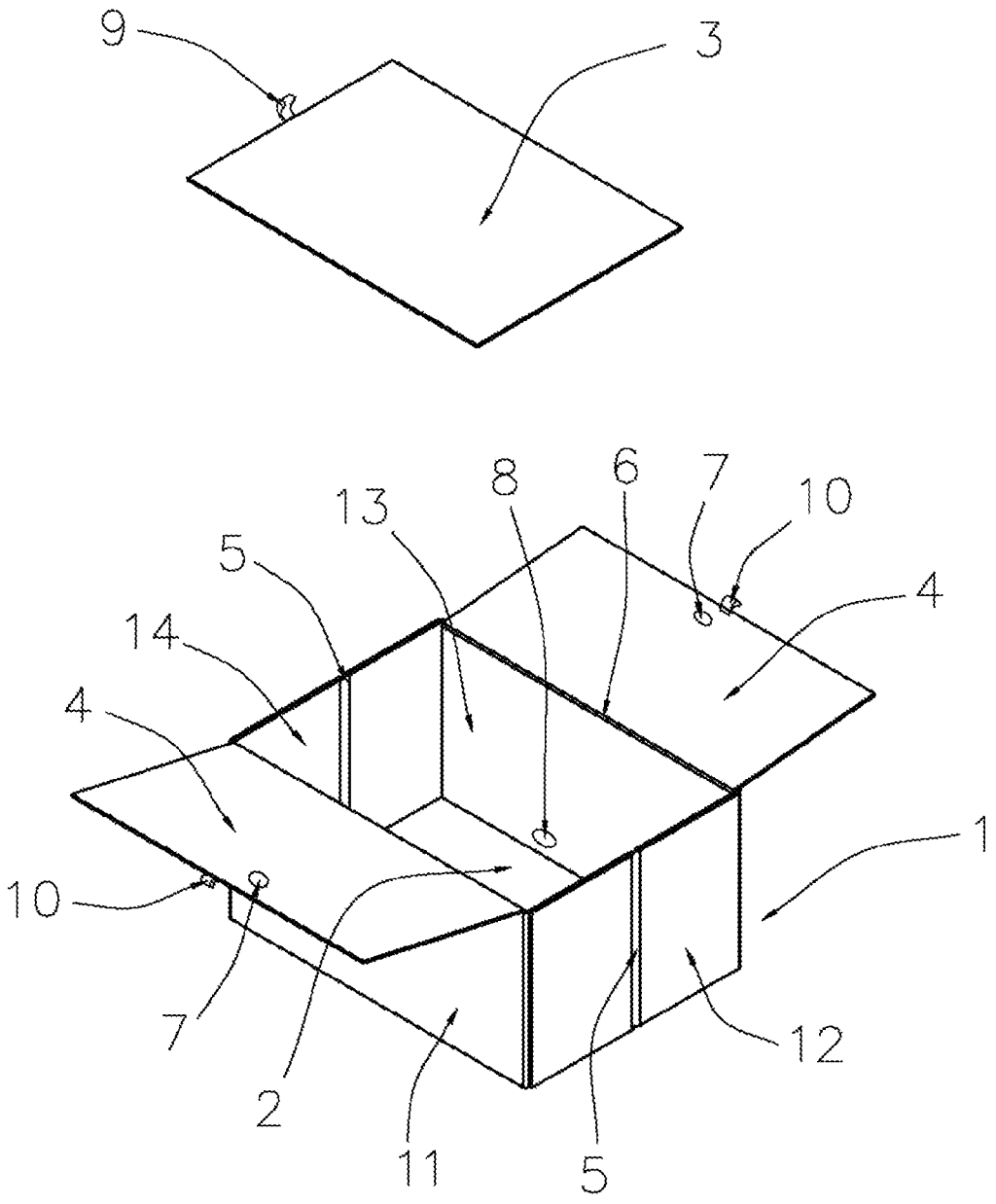
FIG. 5 is an exploded structure diagram of a lug plate according to Embodiment 3 of the present invention when unfolded.
Figure 6:
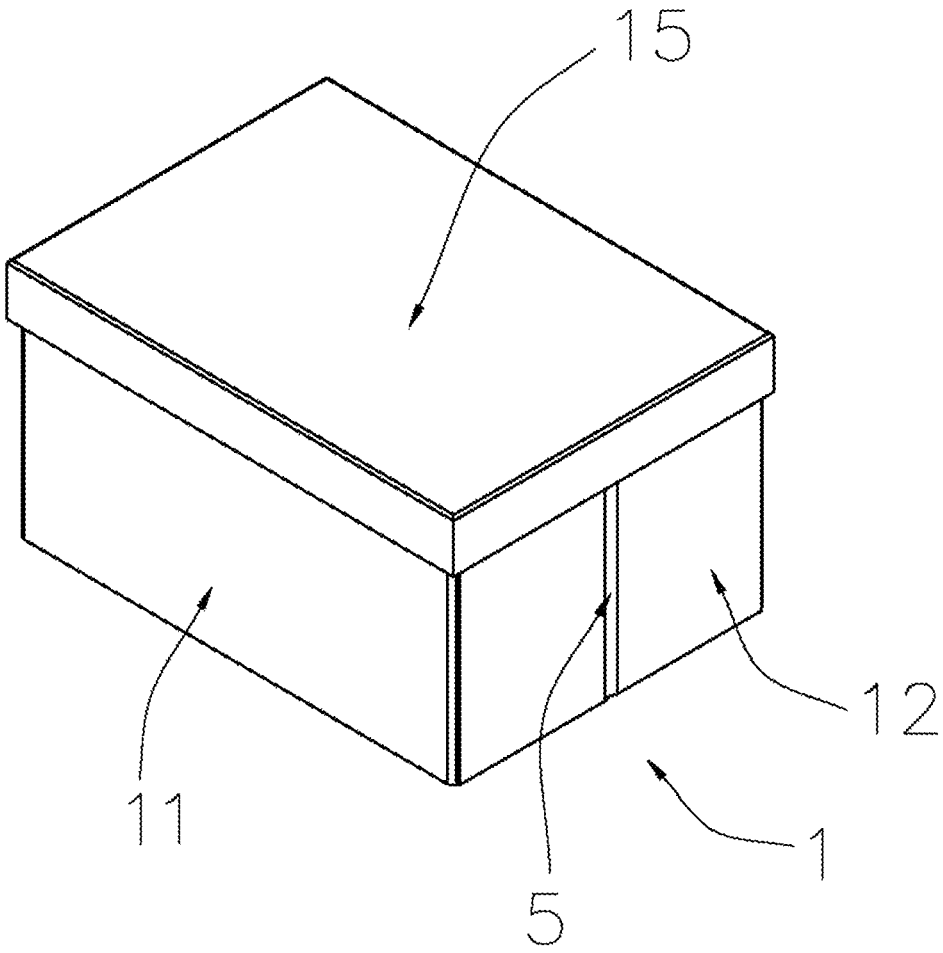
FIG. 6 is a structure diagram of Embodiment 4 of the present invention.

Referring to FIG. 5, the difference between this embodiment and Embodiment 2 is that: the storage box further comprises magnetic buttons for attracting the lug plates 4 with the front side plate 11 and the rear side plate 13, the magnetic buttons comprising auxiliary buttons 7 separately disposed on the two lug plates 4 and main buttons 8 separately disposed at corresponding positions on the front side plate 11 and the rear side plate 13, the auxiliary buttons 7 and the main buttons 8 being attracted together by the magnetism. The auxiliary buttons 7 and the main buttons 8 are preferably magnets attracted with each other. When the storage box disclosed by the present invention is unfolded for use, the arrangement of the magnetic buttons may make the two lug plates 4 further cling to the front side plate 11 and the rear side plate 13 closely, so that the firmness of the lug plates 4 resisting against the soleplate 3 is improved, the event of ineffective resisting caused by free fold-over of the lug plates 4 is avoided, and the structure stability of the storage box disclosed by the present invention is further improved.

Technical characteristics not explained in this embodiment refer to the explanations in Embodiment 2, and will not be repeated here.

Embodiment 4

Figure 7:
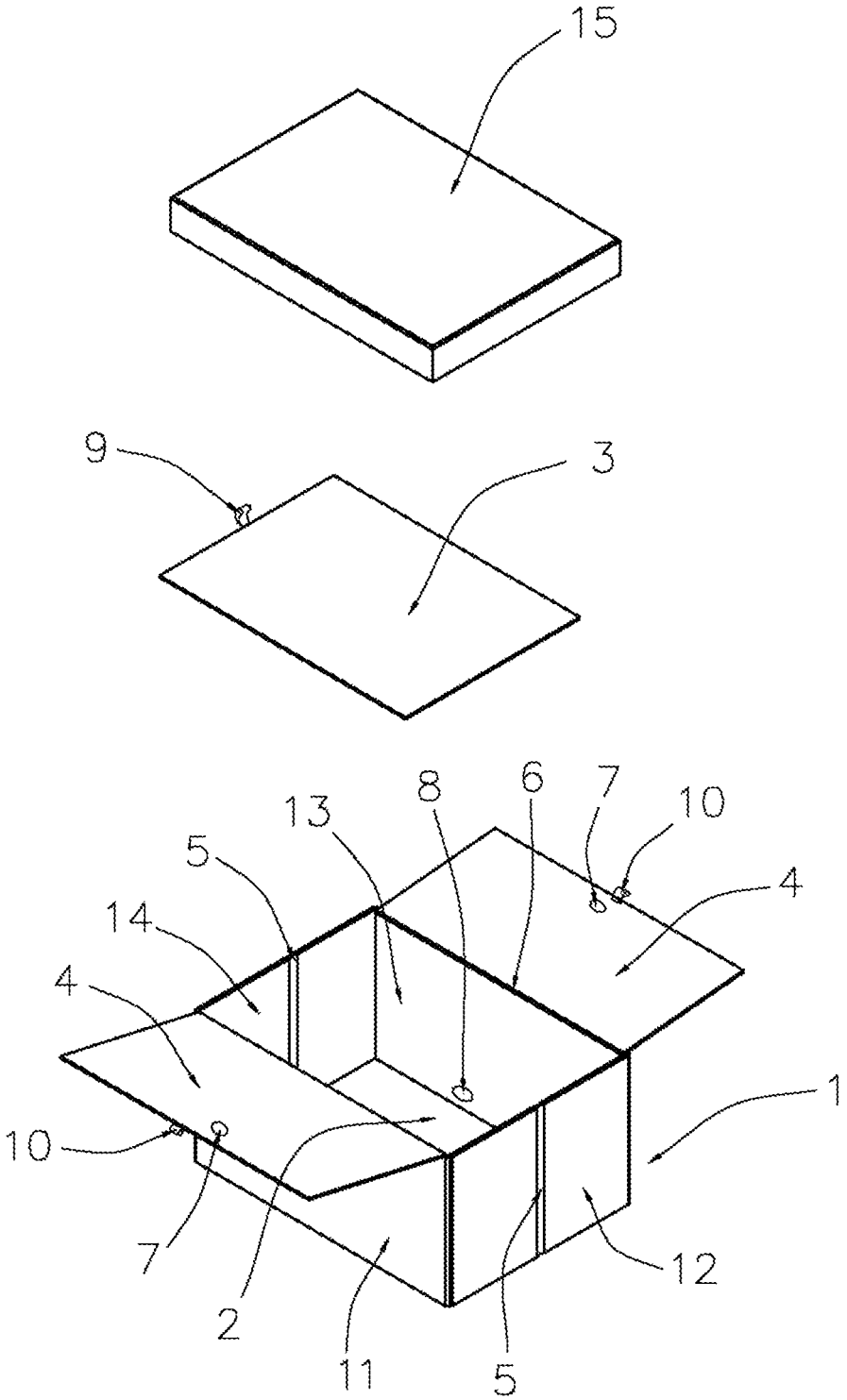
FIG. 7 is an exploded structure diagram of a lug plate according to Embodiment 4 of the present invention when unfolded.
Figure 8:
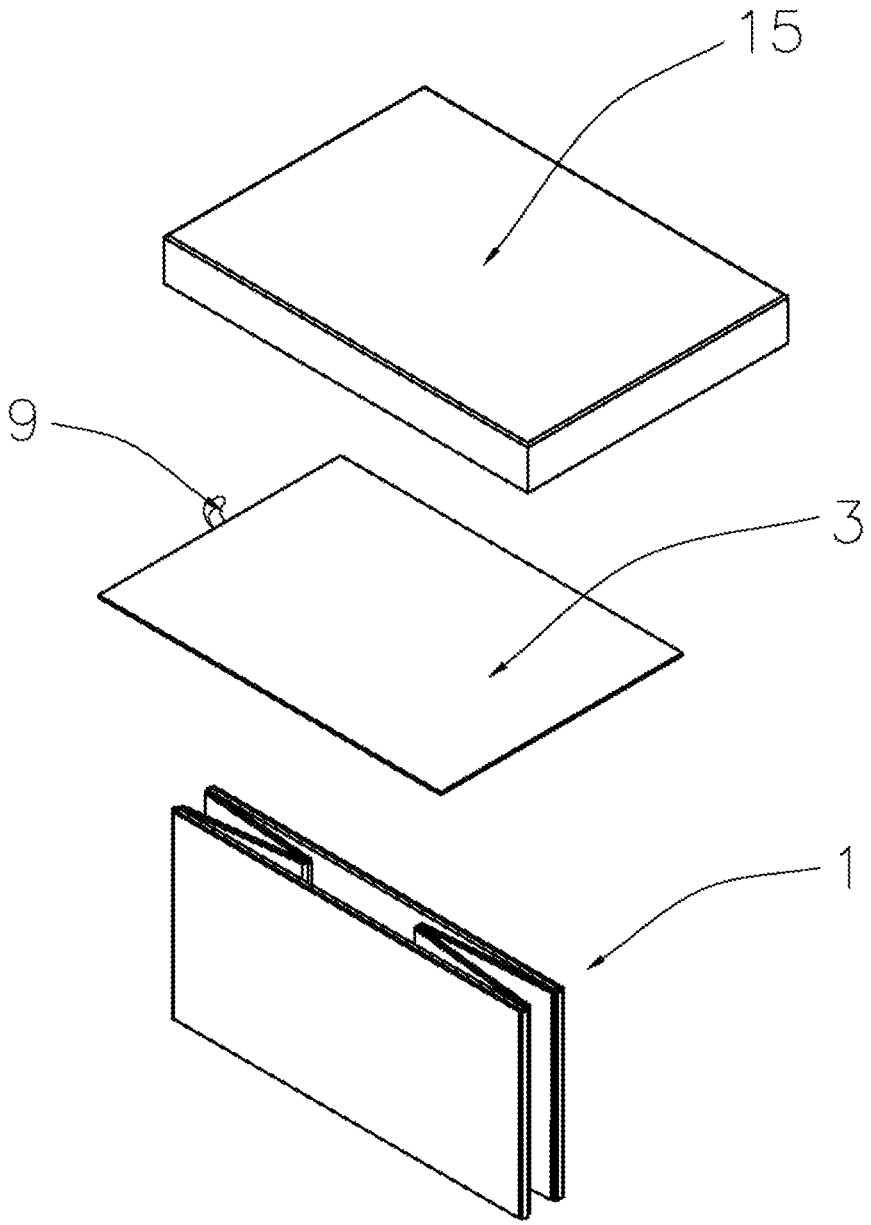
FIG. 8 is an exploded structure diagram of a box main body according to Embodiment 4 of the present invention when folded.
Figure 9:
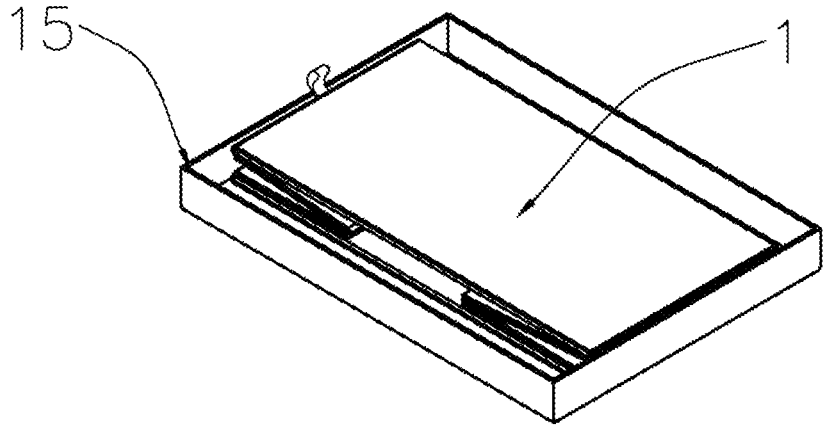
FIG. 9 is a structure diagram of a storage box according to Embodiment 4 of the present invention when folded.

Referring to FIG. 6 to FIG. 9, the difference between this embodiment and Embodiment 2 is that: the storage box further comprises a lid 15 fitted with the box main body 1, and the lid 15 is detachably covered on the top of the box main body 1. The size of the lid 15 is greater than that of the box main body 1 so that the lid 15 may be sheathed on the top of the box main body 1, thereby effectively preventing dusts from entering the inside of the box main body 1 and ensuring the cleanliness and sanitation of the storage box disclosed by the present invention. Referring to FIG. 7 to FIG. 8, the side edges of the box main body 1 are folded inward as directed by the arrows in FIG. 7, so that the folded box main body 1 and the soleplate 3 may be flatly placed inside the lid 15. Thus, the occupation volume is further reduced, and it is convenient for packaging, carrying, transportation and storage.

Technical characteristics not explained in this embodiment refer to the explanations in Embodiment 2, and will not be repeated here.

Finally, it should be noted that the foregoing embodiments are provided just for describing the technical solutions of the present invention, but not intended to limit the protection scope of the present invention. For a person skilled in the art, it should be understood that although the present invention has been described in details with reference to the preferred embodiments, the present invention may have various modifications or equivalent replacements to the technical solutions of the present invention without departing from the essence and scope of the technical solutions of the present invention.

What is claimed is:

1. A storage box, comprising a foldable box main body, the bottom of which provided with a substrate made of soft material, and further comprising a soleplate supporting the box main body, the soleplate being detachably disposed on the substrate, wherein the box main body is also movably connected with two lug plates for resisting against the soleplate, wherein the box main body consists of a front side plate, a right side plate, a rear side and a left side plate connected in turn, the bottoms of the front side plate, the right side plate, the rear side plate and the left side plate being connected with the substrate to form a space for accommodating articles together, wherein the left side plate and the right side plate disposed opposite to each other are symmetrically provided a folding portion, respectively, so that the left side plate and the right side plate can be folded inward along the folding portions; and four edges of the soleplate are resisted against the front side plate, the right side plate, the rear side plate and the left side plate of the main body, and the front side plate and the rear side plate opposite to each other are connected with a respective lug plate for resisting against the soleplate, respectively, the two lug plates being movably connected with the front side plate and the rear side plate in a foldable way.

2. The storage box according to claim 1, further comprising a lid fitted with the box main body, the lid being detachably covered on the top of the box main body.

3. The storage box according to claim 1, wherein the front side plate, the right side plate, the rear side plate and the left side plate are all paperboards, and joints of the front side plate, the right side plate, the rear side plate and the left side plate are all made of high-flexibility material.

4. The storage box according to claim 1, wherein the joints of the two lug plates and the front side plate and the rear side plate are all provided with a fold line.

5. The storage box according to claim 4, further comprising a lid fitted with the box main body, the lid being detachably covered on the top of the box main body.

6. The storage box according to claim 4, further comprising magnetic buttons for attracting the lug plates with the front side plate and the rear side plate, the magnetic buttons comprising auxiliary buttons separately disposed on the two lug plates and main buttons separately disposed at corresponding positions on the front side plate and the rear side plate, the auxiliary buttons and the main buttons being attracted together by the magnetism.

7. The storage box according to claim 6, further comprising a lid fitted with the box main body, the lid being detachably covered on the top of the box main body.

8. The storage box according to claim 1, wherein a soleplate handle is provided at one end of the soleplate, and a moving side of each of the lug plates is provided with a lug plate handle.

9. The storage box according to claim 8, further comprising a lid fitted with the box main body, the lid being detachably covered on the top of the box main body.

10. The storage box according to claim 8, wherein both the soleplate handle and the lug plate handle are thin slices.

11. The storage box according to claim 10, further comprising a lid fitted with the box main body, the lid being detachably covered on the top of the box main body.

* * * * *